US005531577A

United States Patent [19]

Hayase et al.

[11] Patent Number: 5,531,577

[45] Date of Patent: Jul. 2, 1996

[54] SCROLL TYPE FLUID MACHINE HAVING A LEVER DRIVING MECHANISM

[75] Inventors: Isao Hayase, Katsuta; Shigeru Machida, Ibaraki-ken; Shunichi Mitsuya, Ibaraki-ken; Takeshi Kouno, Ibaraki-ken, all of Japan

[73] Assignee: Hitachi, Ltd., Tokyo, Japan

[21] Appl. No.: 185,391

[22] Filed: Jan. 24, 1994

[30] Foreign Application Priority Data

Jan. 26, 1993 [JP] Japan ..... 5-010470

[51] Int. Cl.[6] ..... F01C 1/04; F01C 17/06

[52] U.S. Cl. ..... 418/55.1; 418/57; 417/410.5

[58] Field of Search ..... 418/55.1, 57; 417/410.5

[56] References Cited

U.S. PATENT DOCUMENTS 3,817,664 6/1974 Bennett et al. ..... 418/57

FOREIGN PATENT DOCUMENTS

| | | | |
|---|---|---|---|
| 707807 | 4/1931 | France | 418/55.1 |
| 1653815 | 8/1971 | Germany | 418/55.1 |
| 61-123791 | 6/1986 | Japan | 418/55.1 |
| 2264181 | 10/1990 | Japan . | |

*Primary Examiner*—John J. Vrablik

*Attorney, Agent, or Firm*—Antonelli, Terry, Stout & Kraus

[57] ABSTRACT

A scroll type fluid machine includes a lever 26 moved to draw a conical locus so that revolution is given to an orbiting scroll member 2, to thereby lower a sliding load and a sliding speed of a sliding portion on which a load is acted in a radial direction by the above principle. Further, the orbiting scroll member is supported in a thrust direction by a thrust force transmission member 50 interposed between the orbiting scroll member 2 and a fixed scroll member 1 to thereby lower a sliding speed of the sliding portion on which a load is acted in the thrust direction. With this arrangement, a scroll type fluid machine having high efficiency and durability can be provided.

15 Claims, 8 Drawing Sheets

SCROLL TYPE FLUID MACHINE HAVING A LEVER DRIVING MECHANISM

BACKGROUND OF THE INVENTION

1. Field of the Invention

The present invention relates to a scroll type displacement machine, and more specifically, to a scroll type fluid machine suitably used in a refrigerating cycle of refrigerators and air conditioners.

2. Description of the Related Art

A conventional scroll type compressor uses a crank shaft directly driven by a motor to cause an orbiting scroll member to make revolution as a scroll type compressor, as disclosed, for example, in Japanese Patent Unexamined Publication No. 2-264181, and thus a radial load, which results from the pressure of a compressed gas acting on the scroll wrap portion of the orbiting scroll member, acts on the rotary sliding portion between the crank pin portion of the crank shaft and the orbiting scroll member and to the rotary sliding portion of the bearing of the motor. Further, the position in axial direction of the orbiting scroll member is regulated by such an arrangement that the orbiting scroll member is held between a fixed scroll member and a fixed plate member, and thus a thrust load, which results from a pressure difference of a gas acting on the front and back surfaces of the end plate of the orbiting scroll member, acts on the revolution sliding portion between the orbiting scroll member and the fixed scroll member or to the revolution sliding portion between the orbiting scroll member and the fixed plate member.

Further, U.S. Pat. No. 3,817,664 discloses a scroll type pump having a stationary member and a orbiting scroll supported by a spherical bearing.

The aforesaid prior art has a problem in that since a relatively large radial load is applied to a rotary sliding portion such as a crank pin portion and a bearing which has a large sliding speed, efficiency of a compressor is lowered by a large mechanical friction loss, and further strict sliding conditions are required when operating in a severe operating state, which causes wear and seizure to thereby lower reliability of the compressor. It is general in the scroll type compressor that the revolution sliding portion between the orbiting scroll member or the fixed scroll member and the revolution sliding portion between the orbiting scroll member and the fixed plate member have a relatively small sliding speed, but a thrust load larger than the radial load acts thereon, and thus a problem arises in that a mechanical friction loss due to the thrust load also lowers efficiency of the compressor in the above prior art.

The scroll type pump disclosed in U.S. Pat. No. 3,817,664 has a long distance between the stationary member and the bearing of the orbiting scroll member and this patent has the same problem as that of the aforesaid prior art.

SUMMARY OF THE INVENTION

A first object of the present invention is to lower a mechanical friction loss caused by a radial load acting on respective driving mechanisms to give revolution to a orbiting scroll member to thereby improve efficiency of a compressor as well as to ease the sliding conditions of the respective driving mechanisms to thereby improve reliability of the compressor in a scroll type fluid machine.

A second object of the present invention is to lower a mechanical friction loss produced by a thrust load acting on a orbiting scroll member to thereby improve efficiency of a compressor in a scroll type fluid machine.

To achieve the first object, a scroll type fluid machine according to the present invention, which is arranged such that a fixed scroll member standingly disposed on an end plate and having a scroll wrap portion is combined with a orbiting scroll member standingly disposed on an end plate and having a scroll wrap portion with the scroll wrap portions thereof facing inwardly and the orbiting scroll member is caused to make a orbiting motion with respect to the fixed scroll member by a driving mechanism for giving the orbiting scroll member revolution and a rotation preventing mechanism for preventing the rotation of the orbiting scroll member, wherein the driving mechanism includes a lever, a first supporting portion formed to a stationary member and supporting the lever through spherical surface contraposition, a second supporting portion formed to the orbiting scroll member and supporting the lever through spherical surface contraposition, and a third supporting portion formed to a rotary member and rotatably supporting the lever, and a distance between the first supporting portion and the third supporting portion is set sufficiently longer than a distance between the first supporting portion and the second supporting portion.

Further, in a scroll type fluid machine according to the present invention, the driving mechanism includes a lever, a first supporting portion formed to a stationary member disposed in proximity to the orbiting scroll member and supporting the lever through spherical surface contraposition, a second supporting portion formed to the orbiting scroll member and supporting the lever through spherical surface contraposition, and a third supporting portion formed to a motor for driving the lever and rotatably supporting the lever.

Further, in a scroll type fluid machine according to the present invention, the driving mechanism includes a lever, a first supporting portion formed to a stationary member disposed in proximity to the orbiting scroll member and supporting the lever through spherical surface contraposition, a second supporting portion formed to the orbiting scroll member and supporting the lever through spherical surface contraposition, and a third supporting portion formed in the closed vessel and rotatably supporting the lever.

In a scroll type fluid machine according to the present invention, the driving mechanism supports a lever by a first supporting portion of a stationary member and a second supporting portion of the orbiting scroll member through spherical surface contraposition as well as the lever is supported by a rotary support member formed at a position dislocated in a radial direction from a line passing through the center of the first supporting portion and perpendicular to the end plate of the fixed scroll member.

In a scroll type fluid machine according to the present invention, the driving mechanism supports a lever by a first supporting portion of a stationary member and a second supporting portion of the orbiting scroll member through spherical surface contraposition as well as the lever is rotatably supported on an axis passing through the centers of the first and second supporting portion by using the axis as a relative rotation axis.

In a scroll type fluid machine according to the present invention, the driving mechanism includes a lever supported by a supporting portion of spherical surface contraposition and the lever moves to draw a conical locus.

Further, the stationary member is the fixed scroll member; the stationary member is a first plate member for supporting the fixed scroll member; the supporting portion of the stationary member through spherical surface contraposition is provided at an end of the lever; the second supporting portion is formed to a boss projecting from the end plate of the orbiting scroll member on the side thereof opposite to the side on which the scroll wrap portion is standingly disposed; the second supporting portion is disposed within a surface where the scroll wrap portion is formed; the supporting portion for supporting the lever in spherical surface contraposition is supported through a spherical surface support member having a spherical inner periphery slidingly abutted against a spherical outer periphery provided with the lever and a cylindrical outer periphery abutted against a cylindrical inner periphery provided with the stationary member through spherical surface contraposition; and the supporting portion for supporting the lever is supported through a spherical surface support member having a spherical inner periphery slidingly abutted against a spherical outer periphery provided with the lever and a cylindrical outer periphery abutted against a cylindrical inner periphery provided with a part of the orbiting scroll member through spherical surface contraposition.

Further, a scroll type fluid machine includes a driving motor for driving the lever and a rotary member integrally fixed to the rotor of the motor and the lever is rotatably supported by the rotary member; wherein the rotor has a cavity formed therein and a part of the lever is inserted into the cavity; the rotor is supported by bearings at two positions in the axial direction thereof and a rotary supporting portion of the lever is formed between the two positions supported by the bearings; an axial movement of the rotor is regulated by a thrust bearing and a position to which the axial direction of the rotor is regulated is adjusted by the thrust bearing; and an axial movement of the rotor is regulated by a thrust bearing and an axis force is produced to the rotor in a direction for regulating the movement of the rotor by the thrust bearing by dislocating the magnet centers of the stator and rotor of the driving motor in the axial direction to each other.

Further, a layer of a composite polymer material mainly composed of tetrafluoroethylene is formed on the sliding surface of the spherical surface support member and/or the sliding surface of a corresponding member; the spherical surface support member can be divided in a radial direction; the rotary supporting portion is rotatably supported by the rotary member through a spherical surface bush having a cylindrical inner periphery rotatably abutted against a cylindrical outer periphery provided with the lever and a spherical outer periphery supported by the rotary member through spherical surface contraposition at a position dislocated from the rotation axis of the rotary member; and the spherical surface bush is supported by the rotary member through spherical surface contraposition through a spherical surface support member having a spherical inner periphery slidingly abutted against the spherical outer periphery of the spherical surface bush and a cylindrical outer periphery abutted against a cylindrical inner periphery provided with the rotary member.

Further, a scroll type fluid machine includes a driving motor for driving the lever, wherein the motor is supported by bearings at two positions and one of the positions supported by the bearings use a cylindrical surface formed to the stationary member coaxially with the cylindrical inner periphery abutted against the spherical surface support member as a bearing surface; the driving motor is a DC motor and a part of the lever is disposed in a cavity or a passing-through hole formed in the rotor of the driving motor; the rotor is rotatably supported in a state that an axial movement of the rotor is regulated by a sub-supporting plate disposed on the side opposite to a compression mechanism; and an axial movement of the rotor is regulated by a thrust bearing, and when assembled, a positioning adjustment of the rotor in an axial direction by the thrust bearing and an adjustment of the radial gap of the scroll wrap portion can be simultaneously performed.

To achieve the second object, a scroll type fluid machine according to the present invention, which is arranged such that a fixed scroll member standingly disposed on an end plate and having a scroll wrap portion is combined with a orbiting scroll member standingly disposed on an end plate and having a scroll wrap portion with the scroll wrap portions thereof facing inwardly and the orbiting scroll member is caused to make a orbiting motion with respect to the fixed scroll member by a driving mechanism for giving the orbiting scroll member revolution and a rotation preventing mechanism for preventing the rotation of the orbiting scroll member, comprising a plurality of thrust force transmission members abutting both of the orbiting scroll member and the fixed scroll member through spherical surface contraposition, wherein a relative positional relationship between the centers of a plurality of the spherical surface contrapositions in the orbiting scroll member and a relative positional relationship between the centers of a plurality of spherical surface contrapositions in the fixed scroll member are arranged to make revolution about a plurality of axes perpendicular to the end plate of the orbiting scroll member serving as center axes.

Further, the thrust force transmission member adjusts a distance between the center of spherical surface contraposition of the orbiting scroll member and the center of spherical surface contraposition of the fixed scroll member; and at least one of the thrust force transmission member and the center of spherical surface contraposition in the orbiting scroll member, and the thrust force transmission member and the center of spherical surface contraposition in the fixed scroll member can adjust an axial position to the thrust force transmission member.

Since the scroll type fluid machine according to the present invention is arranged as described above to achieve the first object, the center of spherical surface contraposition between the lever and the stationary member is restricted at point on the stationary member, and the rotation supporting portion provided by the rotary member makes revolution about an axis serving as a rotation axis which is perpendicular to the end plate of the fixed scroll member and passes through the center of spherical surface contraposition between the lever and the stationary member. Consequently, the center of spherical surface contraposition between the lever and the orbiting scroll member also makes revolution by about an axis serving as a rotation axis which is perpendicular to the end plate of the fixed scroll member and passes through the center of spherical surface contraposition between the lever and the fixed member, and thus revolution can be given to the orbiting scroll member.

Although a load resulting from the pressure of a compressed gas acts on the lever through a position wherein the lever is in spherical surface contraposition with the orbiting scroll member, since the lever is supported by the position where the lever is in spherical surface contraposition to the stationary member and the position where the lever is in spherical surface contraposition to the rotary member on the other hand, the load acts by using the position where the lever is in spherical surface contraposition to the orbiting scroll member as a loading point, the position where the lever is in spherical surface contraposition to the fixed member as a fulcrum and the position where the lever is in spherical surface contraposition to the rotary member as a force application point. Since a distance from the fulcrum to the force application point is set longer than a distance from the fulcrum to the loading point, a load applied to the position where the lever is in spherical surface contraposition with the rotary member as the force application point is smaller than a load applied to the position where the lever is in spherical surface contraposition with the orbiting scroll member as the loading point. Further, a load applied to a bearing for supporting the rotation of the rotary member is also reduced.

In the orbiting scroll member, the stationary member and the rotary member which apply a load to and receive a load from the lever, the stationary member is in a stationary state and the orbiting scroll member is also prevented from making rotation by a rotation prevention mechanism such as an Oldham's mechanism etc., and thus only the rotary member makes rotation by rotating about the axis serving as the rotation axis which is perpendicular to the end plate of the fixed scroll member and passes through the center of the spherical surface contraposition between the lever and the stationary member. Since a sum of a load acting between the stationary member and the lever and a load acting between the orbiting scroll member which does not make rotation and the lever becomes sufficiently larger than a load acting between the rotary member which make rotation and the lever, a rotation resistant torque which prevents the rotation of the lever by a frictional force becomes larger than a rotation producing torque for causing the lever to make rotation and thus the rotation of the lever is prevented. Consequently, the lever swingingly slides with respect to the stationary member and the orbiting scroll member with an amount of amplitude on one side which is determined by the center axis of the lever inclined to an axis substantially perpendicular to the end plate of the fixed scroll member.

As described above, in the driving mechanism for giving revolution to the orbiting scroll member, since a rotational sliding motion is performed at the sliding portion between the lever and the rotary member and at the bearing portion of the rotary member, a sliding load is reduced although a sliding speed is increased, and since the swingingly sliding motion is performed at the sliding portion between the lever and the fixed member and at the sliding portion between lever and the orbiting scroll member although a sliding load is increased, a sliding speed is reduced. As a result, since a total sum of a mechanical friction loss due to a radial load in these sliding portions is reduced and sliding portions subjected to particularly severe sliding conditions are removed, efficiency and reliability of the fluid machine such as a compressor etc. are improved.

Since the scroll type fluid machine according to the present invention is arranged as described above to achieve the second object, a plurality of centers of spherical surface contraposition arranged with respect to the thrust transmission member in the orbiting scroll member make revolution about a plurality of axes serving as center axes which pass through the center of spherical surface contraposition arranged with respect to the thrust transmission member in the fixed member and are perpendicular to the end plate of the orbiting scroll member. Consequently, the orbiting scroll member makes revolution while keeping a given direction of the end plate and a given position in the axial direction thereof. At that time, since a movement in the axial direction of the orbiting scroll member is restricted by the fixed member through the thrust force transmission member, the orbiting scroll member does not directly make revolution while it applies a thrust load to and receiving a thrust force from the fixed scroll member and the fixed plate member as in a conventional structure. Consequently, although the position where the orbiting scroll member is in spherical surface contraposition the thrust force transmission member and the position where the fixed member is in spherical surface contraposition the thrust force transmission member, since a sliding speed of these portions become very slower than a revolution sliding speed of the conventional structure, a mechanical frictional loss due to the thrust load is reduced and efficiency of the fluid machine as a compressor etc. is improved.

DESCRIPTION OF PREFERRED EMBODIMENTS

Figure 1:
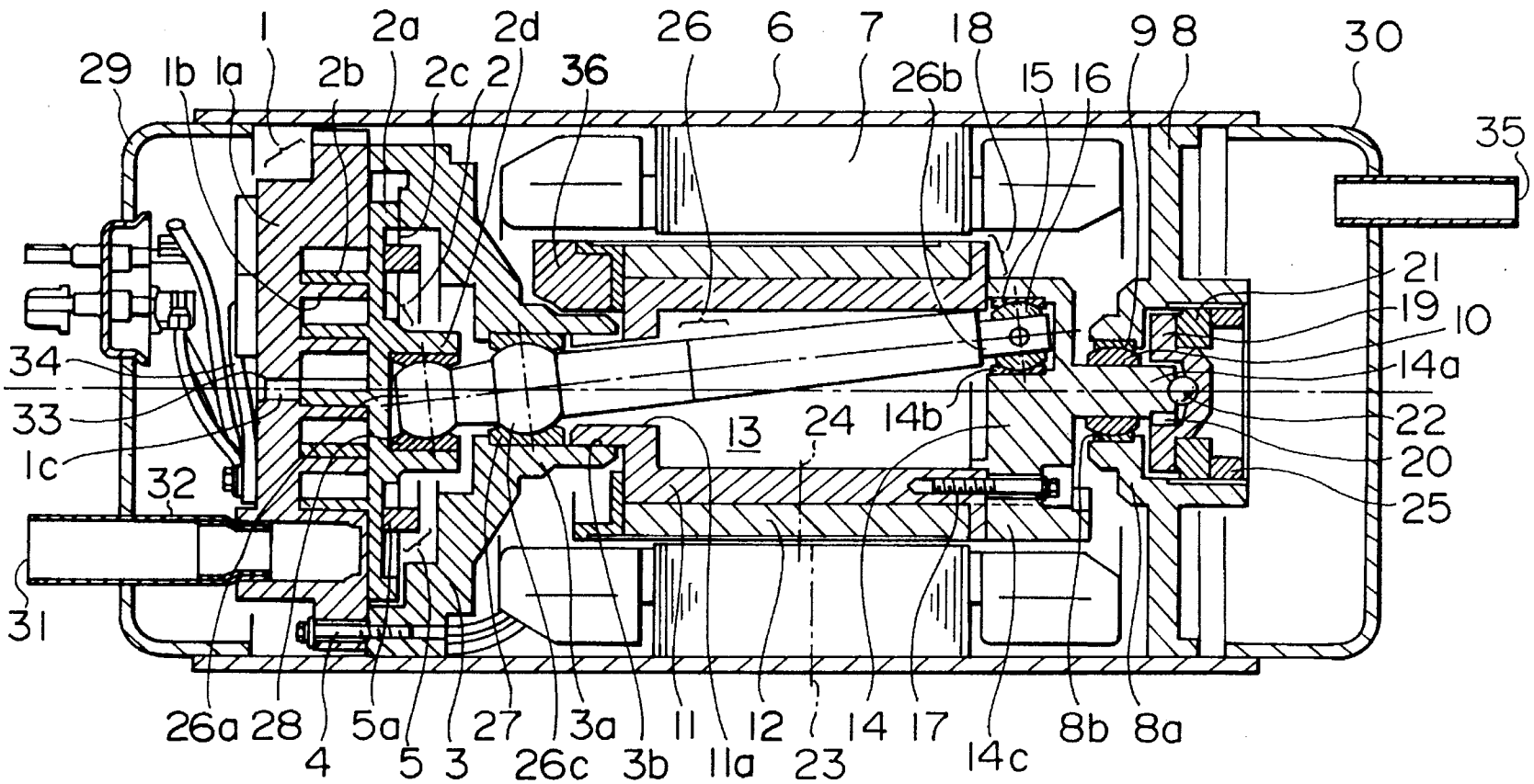
FIG. 1 is a longitudinal cross sectional view of a scroll type compressor according to a first embodiment of the present invention.
Figure 2:
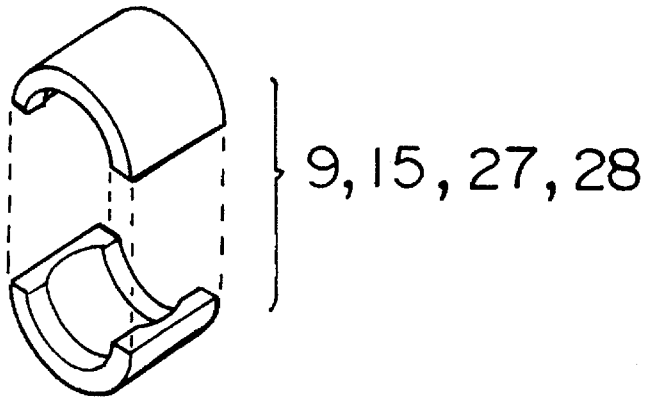
FIG. 2 is a perspective view of a spherical surface support member.
Figure 3:
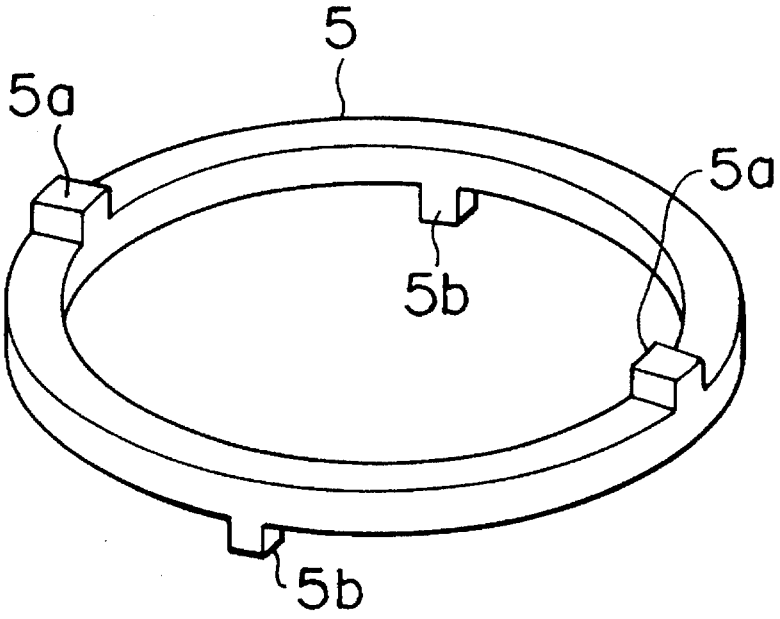
FIG. 3 is a perspective view of an Oldham's ring.
Figure 4:
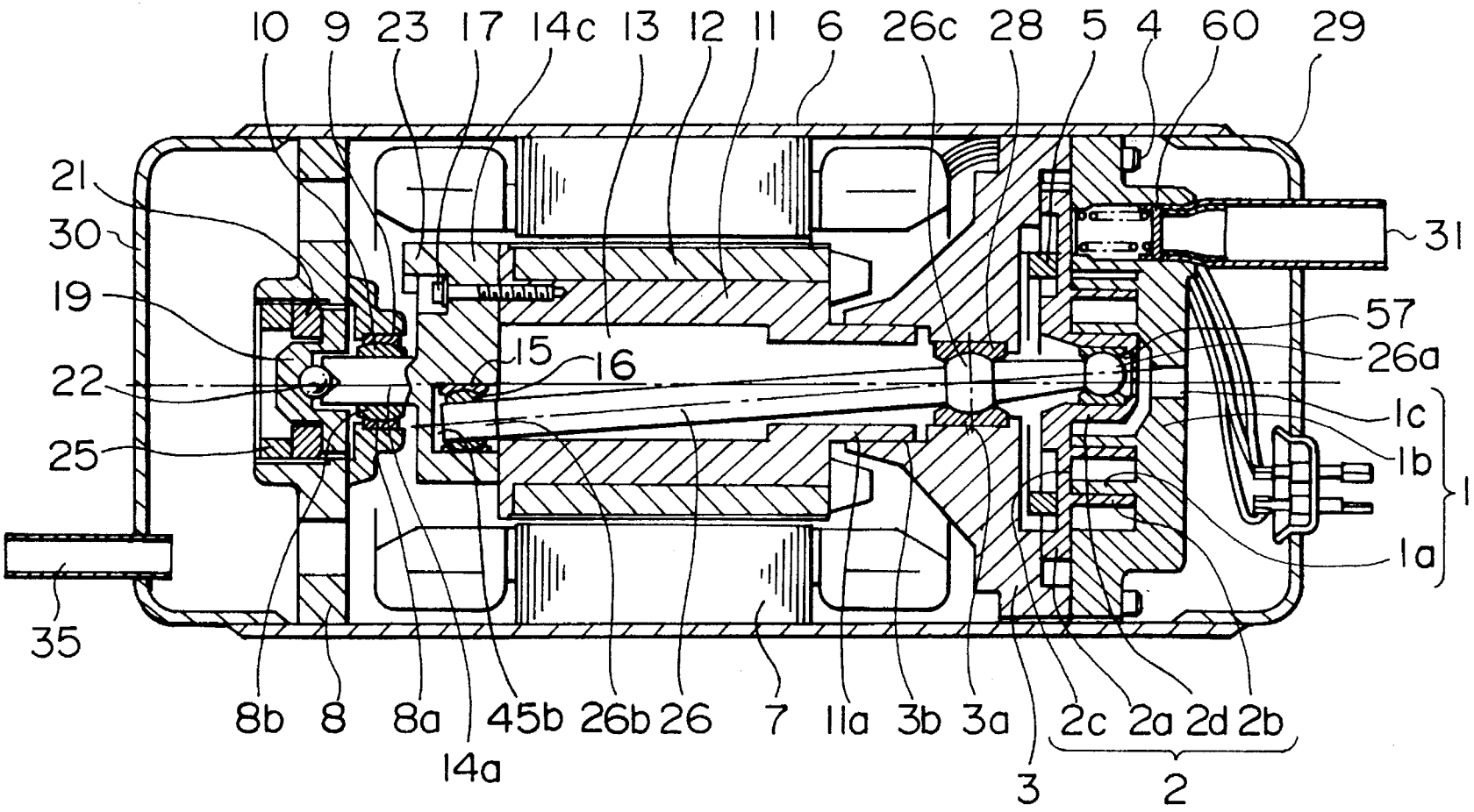
FIG. 4 is a longitudinal cross sectional view of a scroll type compressor as a modification of the first embodiment.

A first embodiment of the present invention will be described below with reference to FIG. 1 to FIG. 4. FIG. 1 is a side cross sectional view of a scroll type compressor as the first embodiment of the present invention, FIG. 2 is a perspective view of a spherical surface support member in the first embodiment, FIG. 3 is a perspective view of an Oldham's ring, and FIG. 4 is a side cross sectional view showing a modification of the scroll type compressor show in FIG. 1.

As shown in FIG. 1, a closed vessel is formed as a whole by welding a first side housing 29 and a second side housing 30 to the openings at the opposite ends of a housing 6. The first side housing 29 is provided with an intake pipe 32 which forms an intake path to cause an operating gas to flow into the compressor, the operating gas being supplied from an outer periphery into a compressing chamber and compressed while moving to a central portion due to the reduction of the volume thereof, and the second side housing 30 is provided with a discharge port 35 for discharging the operating gas to the outside of the compressor. The closed vessel accommodates the compressor and a compressor driving motor and they are arranged as described below.

A fixed scroll member 1 (stationary member) is composed of an end plate 1*a* and a scroll wrap portion 1*b* having a spiral shape of a involute curve etc. An intake port 31 is defined to the outer periphery of the fixed scroll member 1 and a discharge valve 33 for preventing the reverse flow of a discharged operating gas and a discharge valve presser 34 for regulating an amount of displacement of the discharge valve are disposed at the center of the fixed scroll member. An orbiting scroll member 2 is also composed of an end plate 2*a* and a scroll wrap portion 2*b* which are disposed in confrontation with the fixed scroll member 1 so that the scroll wrap portion 2*b* is meshed with the scroll wrap portion 1*b*. A first plate member 3 (stationary member) is fixed to the outer periphery of the fixed scroll member 1 by a bolt 4 so that the orbiting scroll member 2 is surrounded by the plate and an Oldham's ring 5 is assembled between the orbiting scroll member 2 and the first plate member 3. The orbiting scroll member 2 is sandwiched between the fixed scroll member 1 and the first plate member 3 on the outer periphery of the fixed scroll member 1. As shown in FIG. 3, a pair of keys 5*a* are linearly formed to the Oldham's ring 5 on the orbiting scroll member 2 side thereof and inserted into a pair of key ways 2*c* formed to the orbiting scroll member 2.

On the other hand, a pair of keys 5*b* which are disposed linearly are formed to the Oldham's ring 5 on the first plate member 3 side thereof in the direction perpendicular to a pair of the keys 5*a* and inserted into a pair of key ways (not shown) of the first plate member 3. The cylindrical housing 6 is fixed to the outer periphery of the first plate member 3 by welding etc. and further the stator 7 of the compressor driving motor and a second plate member 8 are also fixed to the housing 6. The first plate member 3 and second plate member 8 have bosses 3*a*, 8*a* and cylindrical holes 3*b*, 8*b* formed thereto, respectively, and these holes 3*b*, 8*b* are coaxially disposed each other. Further, a spherical support member 9 having an outer cylindrical surface and an inner peripheral spherical surface is inserted into the hole 8*b* and supports a spherical surface bush 10 to thereby constitute a so-called spherical surface bearing.

As shown in FIG. 1, a main rotor 11 has a shaft 11*a* formed at the left end thereof and permanent magnets 12 is fixed to the outer periphery thereof. Further, as shown in FIG. 1, the main rotor 11 has a cavity 13 formed from an end surface of the shaft 11*a* to the right end surface of the main rotor 1. A sub-rotor 14 has a shaft 14*a* formed at the left end thereof and an opened hole 14*b* is formed at the right end surface thereof and dislocated in a radial direction from the center axis of the shaft 14*a*. A spherical surface support member 15 having an outer cylindrical surface and an inner peripheral spherical surface is inserted into the hole 14*b* and supports a spherical surface bush 16 to thereby constitute a so-called spherical surface bearing. The main rotor 11 is integrally connected to the sub-rotor 14 by a bolt 17 so that the shafts thereof 11*a* and 14*a* are coaxially arranged to thereby form a rotor 18 of the compressor driving motor. The rotor 18 is rotatably supported at the opposite ends thereof in such a manner that the outer periphery of the shaft 11*a* is rotatably supported by the hole 3*b* of the first plate member 3 and as described above the shaft 14*a* is supported by being rotatably inserted into the spherical surface bush 10 supported by the hole 8*b* of the second plate member 8 through the spherical surface support member 9.

Further, a thrust plate 19 is assembled to the extreme end of the shaft 14*a* of the sub-rotor 14 as shown in the figure and rotated together with the rotor 18 by a key 20 so that the thrust plate 19 is abutted against a thrust bearing 21 and performs a rotating slide operation. In this case, since the shaft 14*a* of the sub-rotor 14 is abutted against the thrust plate 19 through a sphere 22, the thrust plate 19 comes into uniform contact with the thrust bearing 21 without partial contact therewith. A thread is formed around the outer periphery of the thrust bearing 21 and thus the thrust bearing 21 is screwed into the second plate member 8 to adjust the axial position thereof, so that the thrust bearing 21 adjusts the axial position of the rotor 18 and is fixed by a lock nut 25. At this time, since the respective magnet centers 23, 24 of the stator 6 and the rotor 18 of the compressor driving motor are axially dislocated in an axial direction each other as shown in the figures and a magnetic force acts on the rotor 18 in a direction by which the thrust plate 21 is abutted against the thrust bearing 22, the axial position of the of the rotor 18 is determined by being regulated by the thrust bearing 21.

A lever 26 has a spherical surface portion 26*a* formed at an end thereof, a cylindrical surface portion 26*b* formed at the other end of thereof and a spherical surface portion 26*c* formed in an intermediate portion between the spherical surface portion 26*a* and the cylindrical surface portion 26*b*. A boss 2*d* defined to the orbiting scroll member 2 is engaged with the spherical surface portion 26*a*, a hole 14*b* defined to the sub-rotor 14 is engaged with the cylindrical surface portion 26*b*, and the spherical surface portion 26*c* is inserted into the hole 3*b* of the first plate member so that an axial line obtained by connecting the spherical center of the spherical surface portion 26*a* and the spherical center of a spherical surface portion 26*c* serves as the center line of the cylindrical surface portion 26*b*, and thus a distance between the center of the spherical surface portion 26*c* and the cylindrical surface portion 26*b* is set sufficiently longer than a distance between the center of the spherical surface portion 26*c* and the center of the spherical surface portion 26*a*. The cylindrical surface portion 26*b* is rotatably inserted into the inner peripheral cylindrical surface portion of the spherical surface bush 16 and rotatably supported thereby and the spherical surface portion 26*c* is supported through spherical surface contraposition by a spherical support member 27 which has an outer peripheral cylindrical portion and an inner peripheral spherical surface portion and inserted into and fixed to the hole 3*b* of the first plate member 3. Further, the spherical surface portion 26*a* of the lever 26 is supported by a spherical surface support member 28 which has an outer cylindrical surface portion and an inner peripheral spherical portion and is inserted into the inner peripheral cylindrical surface of the boss 2*d* standing from the center of the end plate 2*a* through spherical surface contraposition on the opposite side of the scroll wrap portion 2*b* of the orbiting scroll member 2. As shown in FIG. 2, the spherical surface support members 9, 15, 27 and 28 can be divided in a radial direction. The inner peripheral spherical surface portion of these spherical surface support members 9, 15, 27 and 28 can be coated with a composite polymer material mainly composed of a tetrafluoroethylene resin which has a small friction factor even if it is not lubricated. Further, if necessary, a coating layer may be formed to the sliding surface of the corresponding members 10, 16, 26*c* and 26*a* in the same way. Note, in this case, the same coating layer may be formed to the thrust bearing elements 19 and 21 and further the cylindrical surface portion 26*b* and its corresponding surface or the inner surface of the spherical surface bush 16.

With the above arrangement, when the compressor driving motor is supplied with a power and the rotor 18 is rotated, the cylindrical surface portion 26*b* is supported at a position dislocated from the axis of rotation of the rotor 18 and the lever 26 having the spherical surface portion 26*c* supported through spherical surface contraposition about a point on the axis of rotation moves to draw two conical loci having a vertex at the center of the spherical surface contraposition while the central axis of the lever 26 keeps a predetermined inclining angle with respect to the axis of rotation of the rotor 18. Since the lever 26 makes such a motion, the center of the spherical surface portion 26*a* thereof moves circularly so that the orbiting scroll member 2 supported by the spherical surface portion 26*a* through spherical surface contraposition is caused to make revolution. As mentioned above, since an axial portion of the rotor 18 can be adjusted, an axial position of the spherical surface bush 16 for supporting the cylindrical surface portion 26*b* of the lever 26 mounted to the rotor 18 can be also adjusted and thus an inclining angle of the center axis of the lever 26 with respect to the axis of rotation of the lever 26 can be adjusted. Consequently, a radius of revolution of the orbiting scroll member 2 can be adjusted so that an amount of gap between the scroll wrap portion 2*b* of the orbiting scroll member 2 and the scroll wrap portion 1*b* of the fixed scroll member 1 can be adjusted. Further, an amount of gap between the extreme end surface of the scroll wrap portion 2*b* of the orbiting scroll member 2 and the end plate 1*a* of the fixed scroll member 1 and an amount of gap between the extreme end surface of the scroll wrap portion 1*b* of the fixed scroll member 1 and the end plate 2*a* of the orbiting scroll member 2 are kept to the mount of gas determined by the size of these members because the orbiting scroll member 2 is pressed against the fixed scroll member 1 by the pressure of a high pressure gas acting on the surface of the end plate 2*a* of the orbiting scroll member 2 on the side thereof opposite to the scroll wrap portion 2*b*. Therefore, a compression chamber as a closed space is formed by the end plate 1*a* of the fixed scroll member 1, the scroll wrap portion 1*b*, the end plate 2*a* of the orbiting scroll member and the scroll wrap portion 2*b*. As the orbiting scroll member 2 makes revolution by the rotation of the rotor 18 of the compressor driving motor, the compression chamber reduces the volume thereof while moving from the outer peripheral portion to the central portion in the same way as a compressor with a conventional arrangement.

At this time, the operating gas passes through the interior of the intake pipe 32 and then flows into the compressor from the intake port 31 and is sucked into the compression chamber from the outer periphery, where the gas is compressed by the reduction of its volume while moving to the central portion and discharged into the closed vessel from a discharge port 1*c* formed to the center of the end plate 1*a* of the fixed scroll member. Thereafter, the operating gas passes through the gap between the fixed scroll member 1 or the first plate member 3 and the chamber 6 and flows into a motor chamber and then flows to the outside of the compressor from the discharge port 35 formed to the second side chamber 30.

A load acts on the spherical surface portion 26*a* of the lever 26 in a radial direction through the pressure of the compressed gas acting on the scroll wrap portion 2*b* of the orbiting scroll member, and this load is supported by the lever 26 which is restricted by other parts at the spherical surface portion 26*c* and the cylindrical surface portion 26*b*. When it is supposed that the center of the spherical surface portion 26*a* is a loading point, the center of the spherical surface portion 26*c* is a fulcrum, and the center of the spherical surface bush 16 supporting the cylindrical surface portion 26*b* is a force application point, since a distance between the fulcrum and the force application point is sufficiently longer than a distance between the fulcrum and the loading point in this embodiment, a magnitude of a load acting on the force application point is greatly reduced as compared with a magnitude of a load acting on the loading point by the principle of lever. Since the rotor 18, which applies a load to and receives a load from the cylindrical surface portion 26*b* of the lever 26 through the spherical surface bush 16 and the spherical surface support member 15, makes rotation, a rotation producing torque acts on the lever 26 to cause it to make rotation. However, since a load for producing a frictional force is greatly small due to the above reason, the rotation producing torque is small.

On the other hand, since the orbiting scroll member 2 which applies a load to and receives a load from the spherical surface portion 26*a* through the spherical surface support member 28 is prevented from being rotated by the Oldham's ring 5 and the first plate member 3 which applies a load to and receives a load from the spherical surface portion 26*c* through the spherical surface support member 27 is the stationary member which does not make rotation, a rotation resistant torque for preventing the rotation of the lever 26 is applied by the frictional force at these portions. However, since a load for producing the frictional force is relatively large, the rotation resistant torque is large. Therefore, the lever 26 does not make the rotation due to the large rotation resistant torque for preventing the rotation of the lever but makes a swing motion with respect to the spherical surface support members 28 and 27 which make a direct slide motion at the portion where the lever is connected to the orbiting scroll member 2 or the first plate member 3 and makes a relative rotating motion with respect to the spherical surface bush 16 which makes a direct swing motion at the portion where the lever is connected to the rotor 18. More specifically, the lever 26 makes a swing motion at a very small swing speed at the sliding portion on which a relatively large load acts and a load acting on the rotary sliding portion where the lever 26 slides at a relatively high speed is greatly small due to the above principle of lever.

Further, the lever 26 slides at a relatively high speed at the sliding portions between the two shafts 11*a*, 14*a* of the rotor 18 and the spherical surface bush 10 supported through the spherical surface support member 9 by the hole 3*b* of the first plate member 3 and the hole 8*b* of the second plate member 8 by which the shafts 11*a* and 14*a* are rotatably supported, respectively. Since these sliding portions are located on the opposite sides of the rotation support portion provided by the spherical surface bush 16 of the cylindrical surface portion 26*b* of the lever 26 and partially support the in-plane component perpendicular to the axis of rotation of the rotor having a small load acting between the cylindrical surface portion 26*b* of the lever 26 and the spherical surface bush 16, a load acting on these rotary sliding portions is smaller than the small load acting between the cylindrical surface portion 26*b* of the lever 26 and the spherical surface bush 16. More specifically, according to the structure of this embodiment, a sliding speed can reduce any one of the loads in a radial direction at the respective sliding portions of the mechanism for giving revolution to the orbiting scroll member 2.

Consequently, this embodiment is advantageous in that efficiency and durability of the compressor can be improved by the reduction of a mechanical friction loss due to a radial load in the mechanism for giving revolution to the orbiting scroll member 2 and the ease of the sliding conditions.

Further, this embodiment is advantageous in that the center of spherical surface contraposition of the spherical surface portion 26*c* of the lever 26 can be accurately positioned on the axis of rotation of the rotor 18 and the revolution of the orbiting scroll member 2 connected to the spherical surface portion 26*c* at the extreme end of the lever 26 can be easily performed as a correct circular motion by that the common hole 3*b* formed to the boss 3*a* at the center of the first plate member 3 performs the support through spherical surface contraposition of the spherical surface portion 26*c* as the fulcrum of the lever 26 and the rotational support of the rotor 18 for causing the cylindrical surface portion 26*b* as the force application point to make revolution.

Further, this embodiment is advantageous in that the compact arrangement of the compressor is not sacrificed since the lever 26 is partially assembled in the rotor 18 of the compressor driving motor, even if the axial length of the lever 26 is increased to make use of the effect of the lever, the axial length of the compressor as a whole need not be increased.

Further, this embodiment is advantageous in that the performance of the compressor can be improved by the improved sealing property of the operating gas because an amount of gap in a radial direction between the scroll wrap portion 2*b* of the orbiting scroll member 2 and the scroll wrap portion 1*b* of the fixed scroll member 1 can be adjusted by changing a radius of revolution of the orbiting scroll member 2 by changing an inclining angle of the lever 26.

Further, this embodiment is advantageous in that the partial contact of the sliding portion of the lever 26 can be prevented because even if the inclining angle of the lever 26 is changed, the rotor 18 rotatably supports the cylindrical surface portion 26*b* of the lever 26 through the spherical surface bush 16.

Further, this embodiment is advantageous in that although the spherical surface bushes 10, 16 and the spherical surface portions 26*c*, 26*a* of the lever 26 are connected through spherical surface contraposition to other members through the spherical surface support members 9, 15 27, 28, respectively, since these spherical surface support members have a cylindrical outer periphery, they can easily be mounted to the other members from an axial direction.

Further, this embodiment is advantageous in that since the spherical surface support members 9, 15, 27, 28 can be divided in a radial direction, the outer peripheral spherical surface portions of the bushes 10, 13 and the outer peripheral spherical surface portions 26*c*, 26*a* of the lever can be easily assembled to the inner peripheral spherical surface portions of the spherical surface support members 9, 15, 27, 28.

In this embodiment, it should be noted that an unbalanced centrifugal force and unbalanced moment caused by the motion of the orbiting scroll member 2 and lever 26 and the like can be cancelled by a balance weight 36 fixed to the main rotor 11 and a balance weight portion 14*c* formed to a part of the sub-rotor 14 in a direction of 180° with respect to the balance weight 36.

FIG. 4 shows a scroll type compressor having the same arrangement as that shown in FIG. 1, but in this compressor a check valve 60 may be provided with an intake path to prevent the reverse rotation of a orbiting scroll member 2 caused by the reverse flow of an operating medium having a discharge pressure from a discharge port 1*c* to an intake side when the compressor stops, or a discharge port 35 may be disposed to a lower portion when a lubricant is not used or the lubricant is used in a small amount.

Figure 5:
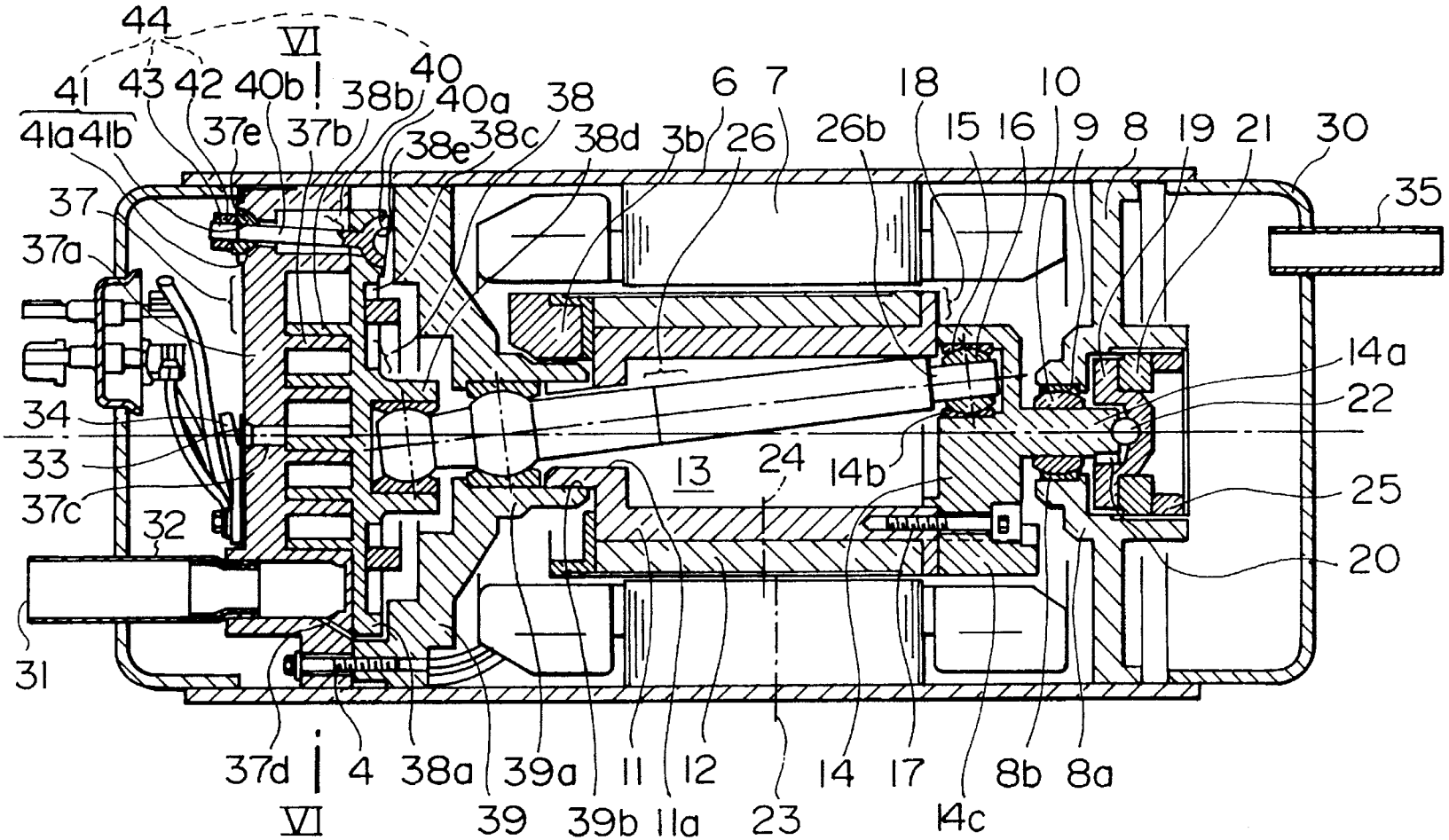
FIG. 5 is a side cross sectional view of a scroll type compressor according to a second embodiment of the present invention.
Figure 6:
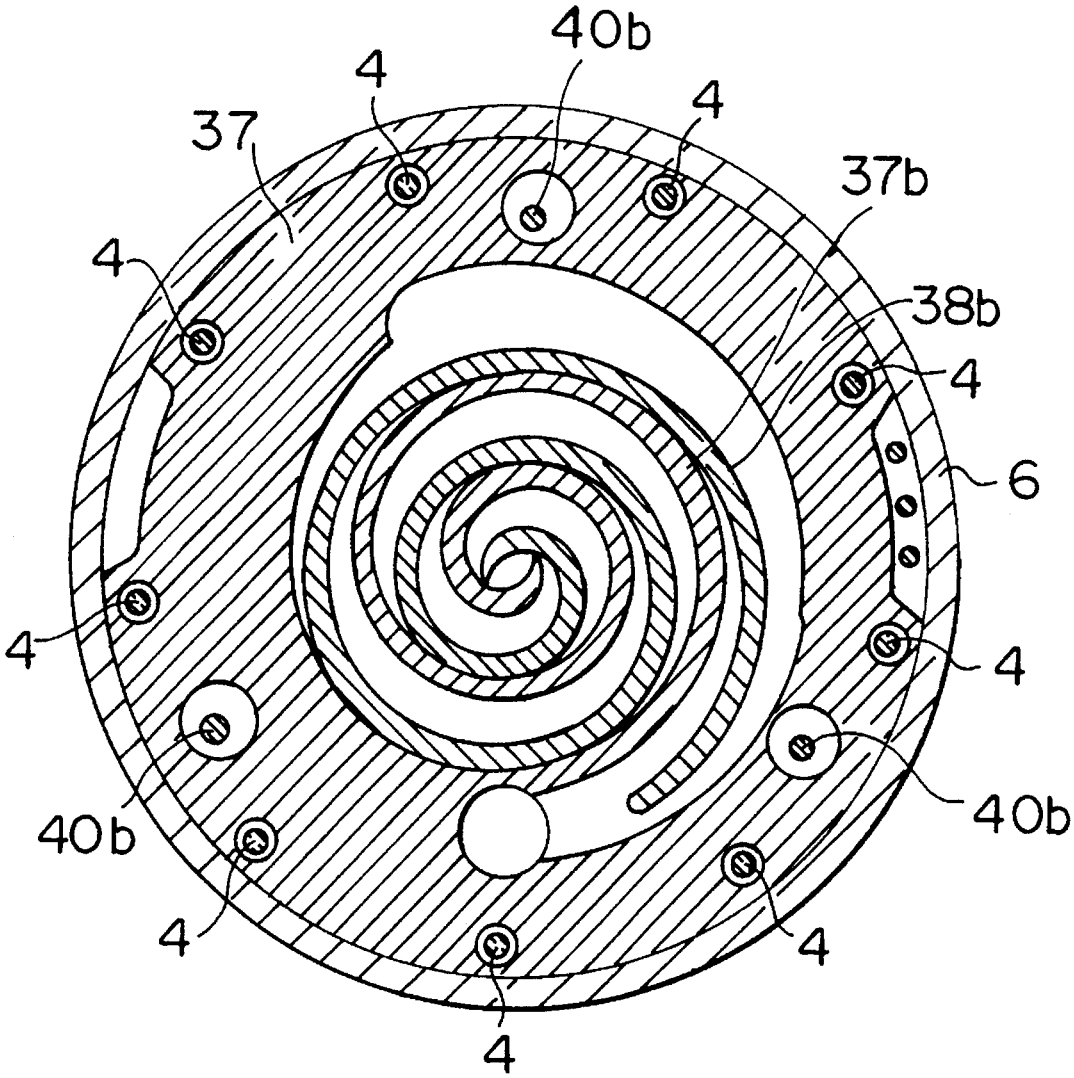
FIG. 6 is a cross sectional view taken long the line VI—VI of FIG. 5.

A second embodiment of the present invention will be described with reference to FIGS. 5 and 6. FIG. 5 is a longitudinal cross sectional view showing a scroll type compressor and FIG. 6 shows a cross sectional view taken along the line VI—VI of FIG. 5. This embodiment will be described with respect to only a portion different to the first embodiment and the portion not described here has the same arrangement as the first embodiment.

As shown in FIGS. 5 and 6, although a first plate member 39 is fixed to the outer periphery of a fixed scroll member 37 by a bolt 4 so that a orbiting scroll member 38 is surrounded by it, the outer peripheries of the fixed scroll member 37 and first plate member 39 are fixed to a housing 6 so that they have gas tightness over the entire peripheries thereof. A pressure in the space between the orbiting scroll member 38 and the first plate member 39 is kept to a low level because the space is communicated with an intake path through a communication hole 37*d* formed to the fixed scroll member 37 and thus a low pressure in an intake state acts on the end plate 38*a* of the orbiting scroll member 38 on the side thereof opposite to a scroll wrap portion 38*b*.

On the other hand, since a pressure of a compressed gas acts on the end plate 38*a* of the orbiting scroll member 38 on the same side thereof as the scroll wrap portion 38*b*, a thrust force for separating the orbiting scroll member 38 from the fixed scroll member 37 acts on the orbiting scroll member 38. As shown in FIG. 5, concave spherical surface portions 37*e*, 38*e* are opened and formed to the end plates of the fixed scroll member 37 and orbiting scroll member 38 on the surfaces thereof opposite to the scroll wrap portions, and the convex spherical surface portion 40*a* of a thrust transmission main member 40 is abutted against the concave spherical surface portion 38*e* and the convex spherical surface portion 41*a* of a thrust transmission sub-member 41 is abutted against the concave spherical surface portion 37*e* through spherical surface contraposition, respectively. The thrust transmission main member 40 and the thrust transmission sub-member 41 are arranged such that the rod 40*b* of the thrust transmission main member 40 passing through holes formed from the concave spherical surface portions 37*e*, 38*e* of the fixed scroll member 37 and orbiting scroll member 38 in the direction of each scroll wrap portion is inserted into the cylindrical hole 41*b* of the thrust transmission sub-member 41, and a distance between the center of the convex spherical surface portion 40*a* and the center of the convex spherical surface portion 41*a* can be adjusted by an adjustment nut 42. The distance between the centers of these convex spherical surface portions is locked to the position of the adjustment nut 42 by a lock nut 43 after an amount of gap between the scroll wrap portion 38*b* of the orbiting scroll member 38 and the end plate 37*a* of the fixed scroll member 37 or an amount of gap between the scroll wrap portion 37*b* of the fixed scroll member 37 and the end plate 38*a* of the orbiting scroll member 38 is adjusted to a fine amount necessary to keep the gas tightness of a compression chamber.

Note, as shown in FIG. 5, thrust force transmission members 44 each composed of these thrust force transmission main member 40, thrust force transmission sub-member 41, adjustment nut 42 and lock nut 43 are assembled at three positions in a circular direction, and the concave spherical surface portions 37*e* of the fixed scroll member 37 and the concave spherical surface portions 38*e* of the orbiting scroll member 38 are also formed at three positions in the circular direction of each end plate. In particular, in this embodiment, a positional relationship between the spherical centers of the concave spherical portions 37*e* at the three positions of the fixed scroll member and a positional relationship between the spherical centers of the concave spherical portions 38*e* of the orbiting scroll member at the three positions are arranged in the same way so that when the orbiting scroll member 38 is moved to a position where the center axis of the boss 38*d* of the orbiting scroll member 38 is caused to lie on the axis of rotation of the rotor 18 of a compressor driving motor, each spherical center of the three concave spherical surface portions 38*e* of the orbiting scroll member 38 lies on one of the spherical centers of the three concave spherical surface portions 37*e* of the fixed scroll member 37, when observed from an axial direction. When this apparatus is actually operated as the compressor, since the center of spherical surface contraposition to a lever at the boss 38*d* of the orbiting scroll member 38 makes revolution about the axis of rotation of the rotor 18 of the compressor driving motor, each of the spherical centers of the three concave surface portions 38*e* of the orbiting scroll member 38 makes revolution with the same radius of revolution as that of the orbiting scroll member 38 about an axis serving as a center axis which passes through one of the three concave spherical surface portions 37*e* of the fixed scroll member 37 and is perpendicular to the end plate 37*a* of the fixed scroll member. Therefore, each of the spherical centers of the three concave spherical surface portions 38*e* of the orbiting scroll member 38 draws a locus parallel with the end plate of the fixed scroll member 37 and thus the orbiting scroll member 38 can keep an attitude parallel with the fixed scroll member 37.

With the above arrangement, the fixed scroll member 37 and the orbiting scroll member 38 on which a thrust force resulting from the pressure of a compressed gas is acted to separate them from each other in the axial direction are prevented from the separation by the thrust force transmission members 44 at the three positions and make relative revolution while keeping a fine amount of gap necessary to secure the gas tightness of the compression chamber and the parallel attitude. At this time, a slide motion is produced in the state that a load for supporting the thrust force acts between the convex spherical surface portion 40*a* of the thrust transmission main member and the concave spherical surface portion 38*e* of the orbiting scroll member and between the convex spherical surface portion 41*a* of the thrust transmission sub-member and the concave spherical surface portion 37*e* of the fixed scroll member, and a sliding speed V1 of these sliding portions is represented by $$V1=R\times\pi\times\sin\theta\times\omega \quad (1)$$

where, a spherical radius of the spherical surface portion is R, an inclining angle of the thrust force transmission member 44 to the axis of rotation of the rotor 18 of the compressor driving motor is θ, and a rotational angular speed of the rotor 18 is ω. On the other hand, a revolution speed V2 of the orbiting scroll member 38 to the fixed scroll member 37 as a stationary member is represented by $$V2=L\times\pi\times\sin\theta\times\omega \quad (2)$$

where, a distance between the spherical centers of the two convex spherical surface portions 40*a*, 41*a* of the thrust force transmission member 44 is L.

Since the first embodiment is arranged such that the orbiting scroll member 2 is directly pressed against the fixed scroll member 1 and thus a sliding speed of the sliding portion where a sliding motion is performed while a load for supporting a thrust force is acted is represented by V2 in the formula (2). In the comparison of the formula (1) with the formula (2), although V1 has a ratio of about (R/L) to V2, (R/L)≈(⅙) in this embodiment, as shown in FIG. 3, and thus a sliding speed in the thrust load support structure of this embodiment can be greatly reduced as compared with that of a conventional thrust load support structure. Note, since the thrust force transmission member 44 is interposed between the fixed scroll member 37 and the orbiting scroll member 38 as an intermediate member in this embodiment, a sliding motion is produced between the thrust force transmission member 44 and the fixed scroll member 37 and between the thrust force transmission member 44 and the orbiting scroll member 38, and thus sliding portions are increased as compared with a conventional structure in which the orbiting scroll member 2 is directly pressed against the fixed scroll member 1, in the same way as the first embodiment. Since, however, a sliding speed in the respective sliding portions can be greatly reduced as described above, it is possible to reduce a mechanical friction loss in these portions.

As described above, according to this embodiment, a sliding speed of the sliding portions by which a thrust force acting on the orbiting scroll member 38 is supported can be reduced, and thus efficiency and durability of the compressor can be improved by lowering the mechanical friction loss due to a thrust load and easing sliding conditions.

A third embodiment of the present invention will be described with reference to FIG. 7. This embodiment intends to reduced a mechanical friction loss by easing a thrust load and sliding conditions in the same way as the second embodiment to thereby improve efficiency and durability of a compressor and has a structure different from the second embodiment in the following points.

Figure 7:
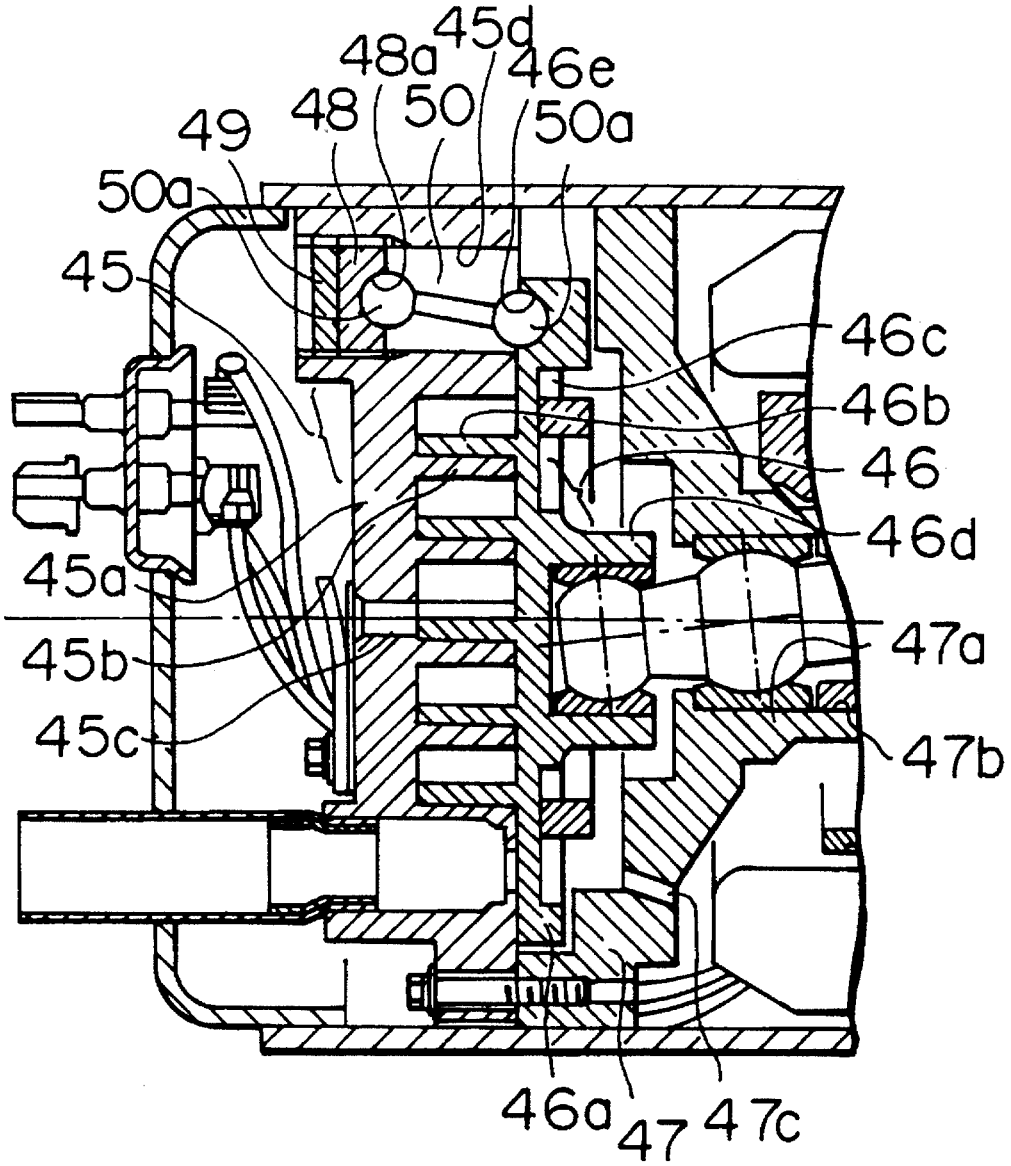
FIG. 7 is a partial longitudinal cross sectional view of a scroll type compressor according to a third embodiment of the preset invention.

As shown in FIG. 7, although a first plate member 47 is fixed to the outer periphery of a fixed scroll member 45 by bolt 4 so that a orbiting scroll member 46 is surrounded by it, a space to which the surface, opposite to a scroll wrap portion 46*b*, of the end plate 46*a* of the orbiting scroll member 46 is exposed is communicated with a high pressure motor chamber through a communication hole 47*c* formed to the first plate member 47. As a result, a high pressure acts on the surface and thus a thrust force to press the orbiting scroll member 46 is pressed against the fixed scroll member 45 acts on the orbiting scroll member 46. The fixed scroll member 45 has axial holes 45*d* formed at three positions of the outer periphery thereof and a spherical surface thrust support member 48 having an concave spherical surface portion 48*a* formed thereto is screwed into each of the holes 45*d* at the central portion thereof with the concave spherical surface portion 48*a* directed toward orbiting scroll member 46 and fixed by a lock nut 49. On the other hand, the orbiting scroll member 46 has concave spherical surface portions 46*e* formed at three positions thereof in confrontation with the concave spherical surface portions 48*a* disposed in the holes 45*d* of the fixed scroll member 45. A positional relationship between the spherical centers of the three concave spherical surface portions 48*a* of the spherical surface support member 48 secured to the fixed scroll member 45 and a positional relationship between the spherical centers of the three concave spherical surface portions 46*e* of the orbiting scroll member 46 are arranged in the same way as those of the second embodiment, and further a positional relationship between the spherical centers of the three concave spherical surface portions 48*a* and the spherical centers of the three concave spherical surface portions 46*e* is also arranged in the same way as that of the second embodiment. A thrust force transmission member 50 is assembled between the spherical surface thrust support member 48 and the orbiting scroll member 46, and convex spherical surface portions 50*a* at the opposite ends thereof are abutted against the concave spherical surface portion 48*a* and the concave spherical surface portion 46*e*, respectively.

Note, a gap in an axial direction of the orbiting scroll member 46 with respect to the fixed scroll member 45 is adjusted to a fine value by adjusting a position at which the spherical surface thrust support member 48 is fixed to the fixed scroll member 45.

With the above arrangement, when revolution is given about the spherical surface contraposition to a lever 26 at the boss 46*d* of the orbiting scroll member 46, the orbiting scroll member 46 and the fixed scroll member 45 are regulated to approach in the axial direction by the thrust force transmission member 5 at the three positions and make relative revolution while keeping a fine amount of gap necessary to secure the gas tightness of a compression chamber and a parallel attitude. As a result, efficiency and durability of the compressor can be improved by the reduction of a mechanical friction loss resulting from a thrust load and the ease of sliding conditions in the same way as the second embodiment. In particular, the scroll type compressor of the second embodiment is arranged such that a force for separating the orbiting scroll member 38 from the fixed scroll member 37 acts on the orbiting scroll member 38 through a peripheral pressure, whereas this embodiment is described by using an example of the scroll type compressor in which a force for causing the orbiting scroll member 46 to approach to the fixed scroll member 45 acts on the orbiting scroll member 46 through a peripheral pressure. This description, however, can be applied regardless of a difference of structure.

Further, although the embodiments 2 and 3 describe the structure in which a load acting on the orbiting scroll member 46 through a peripheral pressure is supported by the fixed scroll member 45 through the thrust force transmission member, it may be supported by other fixed member such as the first plate member in place of the fixed scroll member. In addition, the second and third embodiments describe that the driving mechanism for giving revolution to the orbiting scroll member has the lever 26 assembled thereto. Even if a driving mechanism using a conventional crank shaft, however, can reduce a mechanical friction loss resulting from a thrust load and ease sliding conditions by the application of the thrust load support structure of the orbiting scroll member shown in the embodiments 2 and 3 and achieve the effect that efficiency and durability of a compressor are improved. Note, a plurality of the thrust transmission members more than two are preferably provided with the thrust load support member when the stability of the orbiting scroll member supported by them is taken into consideration.

Sliding conditions of sliding portions which are severe in a scroll type compressor having a conventional structure can be entirely eased by employing the driving mechanism for giving revolution to the orbiting scroll member described in the first to third embodiments in a scroll type compressor, and thus an oil free scroll type compressor which does not need a lubricant in a wide range of operating conditions can be realized by the employment of a sliding material and surface treatment suitable for dry sliding to respective sliding portions.

Figure 8:
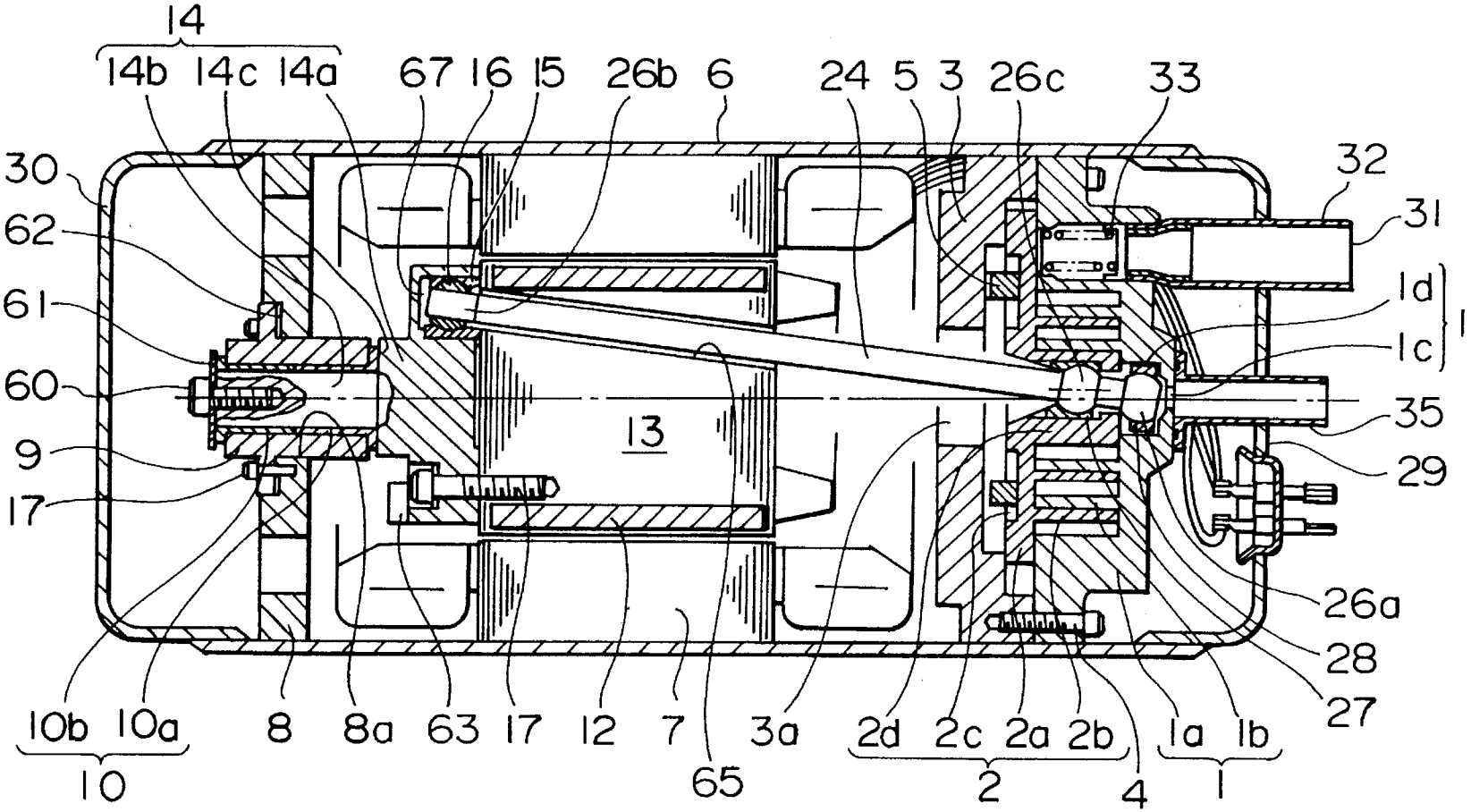
FIG. 8 is a longitudinal cross sectional view of a scroll type compressor according to a fourth embodiment of the preset invention.
Figure 9:
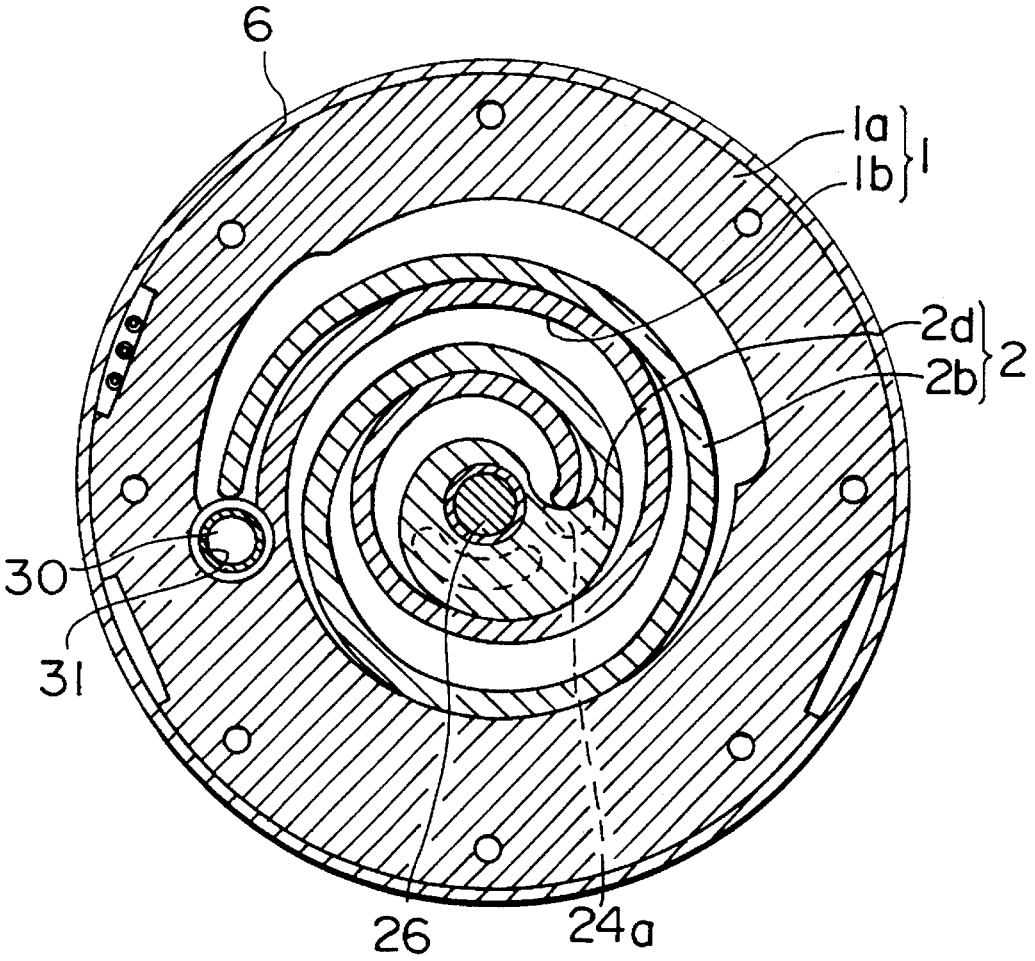
FIG. 9 is a horizontal cross sectional view showing the shape of a scroll wrap portion as in FIG. 8.

A fourth embodiment of the present invention will be described with reference to FIGS. 8 and 9. FIG. 8 is a longitudinal cross sectional view showing a scroll type compressor of this embodiment and FIG. 9 is a cross sectional view perpendicular to an axis showing the meshed state of a scroll wrap portions.

The scroll type compressor of this embodiment is the same as that shown in the first embodiment except the points described below. A hole 8*a* is formed to a bearing support plate 8 and a cylindrical member 9 is fixed to the hole 8*a* by a bolt 17 through a thrust adjustment ring 62. As shown in FIG. 2, a sliding bearing element 10 is disposed to the inner surface of the cylindrical member 9, the sliding bearing element 10 being divided into two parts and each of the parts having a thrust bearing function on the end surface thereof.

A rotor 13 of a compressor driving motor has a plurality of permanent magnets 12 fixed around the outer periphery thereof and an inclined cylindrical cavity 65 is formed in the rotor 13 and passes through the opposite end surfaces of the rotor 13. A sub-rotor 14 is fixed to the rotor 13 by the bolt 17 and has a shaft 14*b* formed to the side thereof opposite to the motor, the shaft 14*b* being rotatably supported by the bearing element integrally provided with the cylindrical member 9. Further, a hole 67 is formed to the sub-rotor 14 on the rotor 13 side thereof, the hole 67 being dislocated in a radial direction from an axis of rotation serving as the center axis of the rotor 13. The hole 67 receives a spherical surface support member 15 having a cylindrical surface portion formed to the outer periphery thereof and a spherical surface portion formed to the inner periphery thereof and a spherical surface bush 16 having a spherical surface portion formed to the outer periphery thereof and a cylindrical surface portion formed to the inner periphery thereof is supported by the spherical surface support member 15 to thereby constitute a so-called spherical surface bearing. A stepped portion 14*c* is formed at the center of the sub-rotor 14 and disposed in confrontation with the thrust surface of the bearing element 10*a*. On the other hand, a thrust receiving ring 61 is fixed to an end surface of the sub-rotor 14*b* by a bolt 60 in confrontation with the thrust surface of the bearing element 10*b*.

With this arrangement, a position in an axial direction of the sub-rotor 144 can be determined by the above two thrust bearings and the thrust adjustment ring 62, and since the thrust adjustment ring 62 can be suitably selected when assembled, the rotor 13 can be disposed at an optimum position. The rotor 13 is supported in a cantilever state by the bearing support plate 8 through the slide bearing 10. A balance weight 63 is provided with the sub-rotor 14 to remove the rotational unbalance of the rotor 13. Note, although not shown in FIG. 8, it is preferable to additionally dispose a balance weight to the right end surface of the rotor 13 in FIG. 8 to more completely remove the rotational unbalance.

A lever 24 has a spherical surface portion 26*a* formed at an end thereof, a cylindrical surface portion 26*b* formed at the other end thereof, and another spherical surface portion 26*c* formed on the spherical surface portion 26*a* side therebetween. A distance between the center of the spherical surface portion 26*c* and the cylindrical surface portion 26*b* is set sufficiently longer than a distance between the center of the spherical surface portion 26*c* and the enter of the spherical surface portion 26*a*, and an axis connecting the spherical center of the spherical surface portion 26*a* to the spherical center of the spherical surface portion 26*c* serves as the center axis of the cylindrical surface portion 26*b*. In the first embodiment, the spherical surface portion serving as the fulcrum is provided with the first plate member, whereas in this embodiment, the arrangement in which the spherical surface portion 26*a* of the lever 24 is supported by a fixed scroll member 1 is employed, that is, the spherical surface portion 26*a* of the lever 24 is supported the by the spherical surface support member 28 which has the cylindrical surface portion on the outer periphery thereof and the spherical surface portion on the inner periphery thereof and is inserted into the hole 1*d* formed to the center of the fixed scroll member 1. Although the spherical surface portion 26*c* of the lever 24 is disposed in the surface to which the scroll wrap portion 2b of the orbiting scroll member 2 is provided, as shown in FIG. 9, the orbiting scroll member has a boss 2d formed to a bulb shape formed at the center thereof as shown in FIG. 9, and the spherical surface portion 26c of the lever 24 is supported through spherical surface contraposition by a spherical surface support member 27 which has a cylindrical surface portion formed on the outer periphery thereof and a spherical surface portion formed on the inner periphery thereof and is inserted into the hole of the boss 2d.

It should be noted that although the spherical surface support members 15, 28 and 27 can be divided into two parts in a radial direction as shown in FIG. 2, the inner peripheral spherical surface portions of these spherical surface support members 15, 28 and 27 are coated with a composite polymer material mainly composed of a tetrafluoroethylene resin which has a low friction factor even if a lubricant is not applied to it, and further, if necessary, a coating layer is preferably formed to the corresponding sliding surfaces (16, 26a, 26c). In this case, the same coating layer may be formed to the bearing element 10 and the surface corresponding to it or the surface of the sub-rotor 14.

With the above arrangement, when the rotor 13 of the compressor driving motor is rotated by being supplied with a power from the outside, the center axis of the lever 24, which has the cylindrical surface portion 26b supported at a position dislocated from the axis of rotation of the rotor 13 and the spherical surface portion 26a supported through spherical surface contraposition about a point on the axis of rotation draws a conical locus having a vertex at the center of the spherical surface portion 26a while keeping a predetermined inclining angle to the axis of rotation of the rotor 13, and thus the center of the spherical surface portion of the lever 24 makes a circular motion, in the same way as the description of the first embodiment. As a result, revolution is given to the orbiting scroll member 2 supported through spherical surface contraposition by the spherical surface portion 26c, the rotation of the orbiting scroll member 2 is prevented by an Oldham's ring disposed on the backside of the orbiting scroll member 2 but an orbiting motion is given to the orbiting scroll member, and thus an operating fluid is sucked and compressed. More specifically, since a rotation resistant torque for preventing the rotation of the lever 24 is increased, the lever 24 does not rotate, makes a swinging motion with respect to the spherical surface support members 28, 27 which directly make a sliding motion at the position where the lever 24 is connected to the orbiting scroll member 2 or a frame member 3, and makes a relative rotational motion only to a spherical surface bush 16 which directly makes a sliding motion at the position where the lever 24 is connected to the rotor 13, in the same way as the first embodiment.

Further, since the rotor 13 can adjust its position in an axial direction in the same as the first embodiment, a position in the axial direction of the spherical surface bush 16 for supporting the cylindrical surface portion 26b of the lever 24 mounted to the rotor 13 can be also adjusted, and thus a orbiting radius of the orbiting scroll member 2 can be adjusted by adjusting an inclining angle of the center axis of the lever 24 to the axis of rotation of the rotor 13 (i.e., an amount of gap in the radial direction of the orbiting scroll member 2 can be adjusted). Further, since the orbiting scroll member 2 is pressed against the fixed scroll member 1 by the pressure of an operating gas acting on the end plate 2a of the orbiting scroll member on the side thereof opposite to the scroll wrap portion 2b, an amount of gap between the extreme end surface of the scroll wrap portion 2b of the orbiting scroll member and the end plate 1a of the fixed scroll member and an amount of gap between the extreme end surface of the scroll wrap portion 1b of the fixed scroll member and the end plate 2a of the orbiting scroll member are kept to the amount of gap determined by the size of these members. More specifically, an mount of gap in the radial direction between the scroll wrap portion 2b of the orbiting scroll member and the scroll wrap portion 1b of the fixed scroll member can be adjusted, and a gap in the axial direction of the scroll wrap portion is determined by the size of the members in the same way as the first embodiment.

A load applied to the spherical surface portion 26c of the lever 24 by the pressure of a compressed gas acting on the scroll wrap portion 2b of the orbiting scroll portion is supported by the lever 24 which is restricted by other parts at the spherical surface portion 26a and the cylindrical surface portion 26b. When it is supposed that the center of the spherical surface portion 26c is a loading point, the center of the spherical surface portion 26a is a fulcrum, and the center of the spherical surface bush 16 for supporting the cylindrical surface portion 26b is a force application point, however, since the fulcrum is formed to the fixed scroll member, this embodiment is advantageous in that a distance between the fulcrum and the force application point can be more increased than a distance between the fulcrum and the loading point in the first embodiment. Consequently, any one of a sliding speed and a sliding load in the radial direction can be reduced at the respective sliding portions of the mechanism for giving a orbiting motion to the orbiting scroll member 2, also in this embodiment. More specifically, the lever 24 makes a swinging motion at a very slow sliding speed at the sliding portion on which a relatively large load is acted, and a load acting on the rotary sliding portion which slides at a relatively high speed can be greatly reduced by this principle.

What is claimed is:

1. A scroll type fluid machine comprising a fixed scroll member having a scroll wrap portion standingly disposed on an end plate, an orbiting scroll member having a scroll wrap portion standingly disposed on an end plate, the orbiting scroll member being combined with the fixed scroll member so as for the scroll wrap portions thereof to face inwardly each other, a driving mechanism for giving the orbiting scroll member revolution, and a rotation preventing mechanism for preventing the rotation of the orbiting scroll member, the orbiting scroll member being caused to make an orbiting motion with respect to the fixed scroll member by the driving mechanism and the rotation preventing mechanism, wherein said driving mechanism includes a single rigid lever, a first supporting portion formed in a stationary member for supporting said lever through spherical surface contraposition, a second supporting portion formed in said orbiting scroll member for supporting said lever through spherical surface contraposition, and a third supporting portion formed in a rotary member for rotatably supporting said lever, and a distance between said first supporting portion and said third supporting portion is set longer than a distance between said first supporting portion and said second supporting portion.

2. A scroll type fluid machine comprising a fixed scroll member having a scroll wrap portion standingly disposed on an end plate, an orbiting scroll member having a scroll wrap portion standingly disposed on an end plate, the orbiting scroll member being combined with the fixed scroll member so as for the scroll wrap portions thereof to face inwardly each other, a driving mechanism for giving the orbiting scroll member revolution, and a rotation preventing mechanism for preventing the rotation of the orbiting scroll member, the orbiting scroll member being caused to make an orbiting motion with respect to the fixed scroll member by the driving mechanism and the rotation preventing mechanism, wherein said driving mechanism includes a lever, a first supporting portion formed in a stationary member disposed in proximity to said orbiting scroll member so as to support said lever through spherical surface contraposition, a second supporting portion formed in said orbiting scroll member for supporting said lever through spherical surface contraposition, and a third supporting portion formed in a motor for driving said lever and rotatably supporting said lever.

3. A scroll type fluid machine according to claim 1 or 2, wherein said stationary member is a first plate member for supporting said fixed scroll member.

4. A scroll type fluid machine according to of claim 1 or 2, wherein the supporting portion of said stationary member through spherical surface contraposition is provided at an end of said lever.

5. A scroll type fluid machine according to claim 1 or 2, wherein said second supporting portion is formed in a boss projecting from the end plate of said orbiting scroll member on the side thereof opposite to the side on which said scroll wrap portion is standingly disposed.

6. A scroll type fluid machine according to claim 1 or 2, including a driving motor for driving said lever and a rotary member integrally fixed to a rotor of said motor and said lever is rotatably supported by said rotary member.

7. A scroll type fluid machine according to claim 6, wherein said rotor has a cavity or a passing-through hole formed therein and a part of said lever is inserted into said cavity or passing-through hole.

8. A scroll type fluid machine according to claim 6, wherein said rotor is supported by bearings at two positions in the axial direction thereof and a rotatably supporting portion of said lever is formed between the two positions supported by said bearings.

9. A scroll type fluid machine according to claim 6, wherein an axial movement of said rotor is regulated by a thrust bearing and a position to which the axial direction of said rotor is regulated is adjusted by said thrust bearing.

10. A scroll type fluid machine according to claim 6, wherein an axial movement of said rotor is regulated by a thrust bearing and an axis force is produced to said rotor in a direction for regulating the movement of said rotor by said thrust bearing by dislocating magnet centers of the stator and rotor of said compressor driving motor in the axial direction to each other.

11. A scroll type fluid machine according to claim 6, wherein said spherical surface support member can be divided in a radial direction.

12. A scroll type fluid machine according to claim 1 or 2, wherein said rotatably supporting portion is rotatably supported by said rotary member through a spherical surface bush having a cylindrical inner periphery rotatably abutted against a cylindrical outer periphery provided with said lever and a spherical outer periphery supported by said rotary member through spherical surface contraposition at a position dislocated from the rotation axis of said rotary member.

13. A scroll type fluid machine according to claim 12, wherein said spherical surface bush is supported by said rotary member through spherical surface contraposition through a spherical surface support member having a spherical inner periphery slidingly abutted against the spherical outer periphery of said spherical surface bush and a cylindrical outer periphery abutted against a cylindrical inner periphery provided with said rotary member.

14. A scroll type fluid machine according to claim 1, including a driving motor for driving said lever, wherein said motor is supported by bearings at two positions and one of the positions supported by said bearings is said first supporting member in said stationary member.

15. A scroll type fluid machine according to claim 14, wherein the rotor of said driving motor has permanent magnets in its outer periphery and a part of said lever is disposed in a cavity or a passing-through hole formed in the rotor of said driving motor.

* * * * *